US007025894B2

(12) United States Patent
Hess et al.

(10) Patent No.: US 7,025,894 B2
(45) Date of Patent: Apr. 11, 2006

(54) FLUID-EJECTION DEVICES AND A DEPOSITION METHOD FOR LAYERS THEREOF

(75) Inventors: Ulrich E. Hess, Corvallis, OR (US); Samson Berhane, Corvallis, OR (US); Arjang Fartash, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 134 days.

(21) Appl. No.: 10/620,666

(22) Filed: Jul. 16, 2003

(65) Prior Publication Data

US 2004/0070649 A1 Apr. 15, 2004

Related U.S. Application Data

(63) Continuation-in-part of application No. 09/978,985, filed on Oct. 16, 2001, now abandoned.

(51) Int. Cl.
*B41J 2/04* (2006.01)

(52) U.S. Cl. ..... 216/27; 216/41; 347/54; 347/65; 118/718

(58) Field of Classification Search ..... 216/27, 216/41; 347/54, 65; 118/719, 718
See application file for complete search history.

(56) References Cited

U.S. PATENT DOCUMENTS

| | | | | |
|---|---|---|---|---|
| 4,058,430 | A | | 11/1977 | Suntola et al. |
| 4,339,762 | A | | 7/1982 | Shirato et al. |
| 4,488,084 | A | | 12/1984 | Lindfors et al. |
| 4,513,298 | A | | 4/1985 | Scheu |
| 4,532,530 | A | | 7/1985 | Hawkins |
| 4,708,915 | A | | 11/1987 | Ogawa et al. |
| 4,828,935 | A | | 5/1989 | Jonker et al. |
| 4,862,197 | A | * | 8/1989 | Stoffel ..... 347/59 |
| 4,872,028 | A | | 10/1989 | Lloyd |
| 4,967,208 | A | | 10/1990 | Childers |
| 4,982,199 | A | | 1/1991 | Dunn |
| 5,083,137 | A | | 1/1992 | Badyal et al. |
| 5,168,284 | A | | 12/1992 | Yeung |
| 5,187,500 | A | | 2/1993 | Bohorquez et al. |
| 5,194,877 | A | | 3/1993 | Lam et al. |
| 5,227,812 | A | | 7/1993 | Watanabe et al. |
| 5,294,286 | A | | 3/1994 | Nishizawa et al. |
| 5,357,081 | A | | 10/1994 | Bohorquez |
| 5,418,558 | A | | 5/1995 | Hock et al. |
| 5,428,376 | A | | 6/1995 | Wade et al. |
| 5,526,027 | A | | 6/1996 | Wade et al. |
| 5,530,465 | A | | 6/1996 | Hasegawa et al. |
| 5,742,322 | A | | 4/1998 | Cranton et al. |
| 5,883,650 | A | * | 3/1999 | Figueredo et al. ..... 347/62 |
| 5,916,365 | A | | 6/1999 | Sherman |

(Continued)

FOREIGN PATENT DOCUMENTS

EP 0729834 A2 9/1996

(Continued)

OTHER PUBLICATIONS

J. Stephen Aden et al.; "The Third Generation HP Thermal Inkjet Printhead"; pp: 41-45; Hewlett-Packard Company Journal; Feb. 1994.

*Primary Examiner*—Shamim Ahmed

(57) ABSTRACT

Atomic layer deposition forms a cavitation layer of a print head.

7 Claims, 2 Drawing Sheets

U.S. PATENT DOCUMENTS 6,007,188 A 12/1999 MacLeod et al.
6,046,758 A 4/2000 Brown et al.
6,065,823 A 5/2000 Kawamura
6,123,419 A 9/2000 Cleland
6,126,276 A 10/2000 David et al.
6,139,131 A 10/2000 Prasad et al.
6,287,965 B1 * 9/2001 Kang et al. ..... 438/648
6,293,654 B1 9/2001 Pidwerbecki
6,328,428 B1 12/2001 Keefe et al.
2002/0094663 A1 7/2002 Kwon et al.

FOREIGN PATENT DOCUMENTS

EP 0750990 A2 1/1997
EP 0794057 A1 9/1997
EP 0825026 A2 2/1998

* cited by examiner

FLUID-EJECTION DEVICES AND A DEPOSITION METHOD FOR LAYERS THEREOF

CROSS REFERENCE TO RELATED APPLICATIONS

This Application is a Continuation-in-Part of U.S. application Ser. No. 09/978,985 filed Oct. 16, 2001, abandoned, which application is incorporated herein by reference.

BACKGROUND

Commercial products having imaging capability, such as computer printers, graphics plotters, facsimile machines, etc., have been implemented with fluid-ejection devices producing printed media. In many cases, such devices utilize inkjet technology whereby an inkjet image is created when a precise pattern of dots is formed on a printing medium from ejected ink droplets. Typically, an inkjet print head is supported on a movable carriage that traverses over the surface of the print medium and is controlled to eject drops of ink at appropriate times pursuant to commands of a microcomputer or other controller, wherein the timing of the application of the ink drops is intended to correspond to a pattern of pixels of the image being printed. A typical inkjet print head includes an array of precisely formed nozzles in an orifice plate. The plate is attached to a thin-film substrate that implements ink firing heater resistors and apparatus for enabling the resistors. The thin-film substrate is generally comprised of several thin layers of insulating, conducting, or semiconductor material that are deposited successively on a supporting substrate, or die, in precise patterns to form collectively, all or part of an integrated circuit.

The thin-film substrate or die is typically comprised of a layer, such as silicon, on which are formed various thin-film layers that form thin-film ink firing resistors, apparatus for enabling the resistors, and interconnections to bonding pads that are provided for external electrical connections to the print head. Ongoing improvements in the design of fluid-ejection devices have resulted in more efficient print-head components, such as resistors barrier layers, and passivation layers. In some cases, barrier layers and passivation layers deposited by physical vapor deposition or chemical vapor deposition methods have been utilized to improve performance. In other cases; sputtering techniques have been used to form barrier layers and passivation layers. While these techniques have some utility, it is desirable to have an improved barrier layers and passivation layers capable of improving performance and increasing resistor life.

Of course, energy expenditure is necessary for operation of fluid-ejection devices. In this regard, the term "turn-on energy" relates to the energy required to form a vapor bubble of a size sufficient to eject a predetermined amount of ink volume through a print head nozzle. With ever increasing usage of electrically driven devices, conservation becomes an important consideration. With respect to fluid-ejection devices, a reduction in "turn-on energy" would be desirable, especially if such reduction produced improved print head performance and prolonged print head life.

SUMMARY

One embodiment of the present invention provides a method of forming a cavitation layer of a print head. The method includes utilizing an atomic layer deposition process.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Embodiments of the present invention involve forming layers of fluid-ejection devices, such as print heads, using atomic layer deposition (ALD). ALD involves depositing a selected composition on crystalline or amorphous substrates or layers one molecular layer at a time. Unlike atomic layer epitaxy (ALE) processes that involve growing a single crystalline layer on a crystalline substrate or layer that mimics the substrate or layer, ALD does not require a crystalline substrate or layer, as does ALE. ALE operates in a ultra-high-to-high vacuum, e.g., corresponding to absolute pressures from about $10^{-10}$ to about $10^{-7}$ Torr, whereas ALD operates in medium-to-low vacuum, e.g., corresponding to absolute pressures from about $10^{-3}$ to about 1 (one) Torr.

For one embodiment, a passivation layer is formed on a surface of a substrate. The passivation layer generally protects exposed elements of the fluid-ejection device from environmental contaminants, e.g., fluids, such as ink, thus ensuring electrical stability of the fluid-ejection device. For another embodiment, the passivation layer is a thin dielectric layer. The passivation layer is deposited using the ALD process referred to herein as, for example, an ALD dielectric or an ALD passivation layer, as appropriate. In other embodiments, a cavitation layer of a firing chamber of the fluid-ejection device is formed using ALD and is referred to herein as an ALD cavitation layer, for example.

Figure 1:
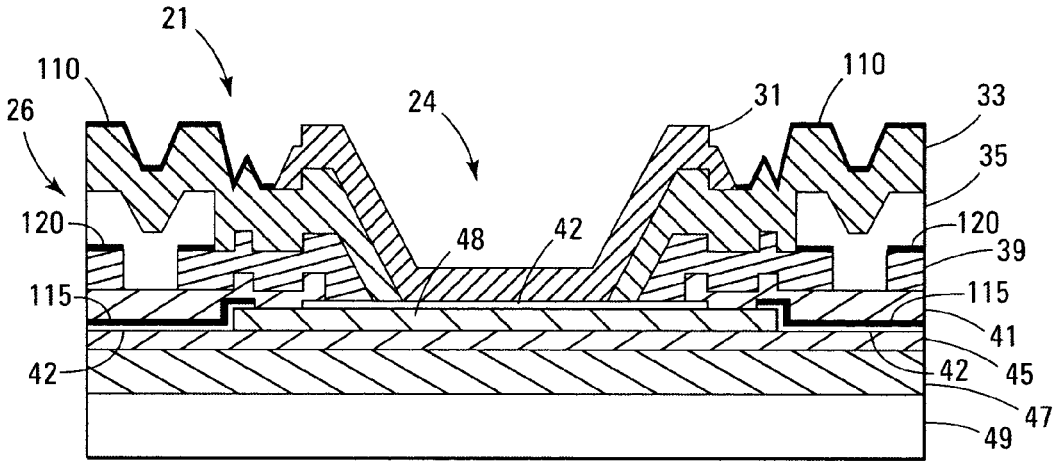
FIG. 1 is a cross-sectional view of a portion of a fluid-ejection device according to an embodiment of the present invention.

FIG. 1 is an unscaled cross-sectional view of a portion of a fluid-ejection device (or print head) 21 according to an embodiment of the present invention. The fluid-ejection device 21 is comprised of a plurality (or stack) of thin film layers, generally indicated by the reference numeral 26, that are stacked atop a die 49. Contact termination in the print head is also shown in FIG. 1, as described in more detail below.

The layers over the die 49 form thin-film ink firing resistors or heating elements, such as a resistive layer (or resistor) 48, and an apparatus for enabling the resistors. In a particular embodiment, the die 49 (e.g., about 650 microns thick) is composed of silicon. The silicon die 49 is a semiconductor that functions as a substrate to support the overlying layers. In this regard, immediately overlying the die 49 there is formed by plasma enhanced chemical vapor deposition (PECVD) of a tetra ethyl ortho silicate (TEOS) or silane (SiH4) based oxide (e.g., about 1.0 micron thick) layer 47. This layer insulates the overlying inkjet circuitry from the silicon die 49 and provides thermal isolation from the silicon, thereby keeping the circuitry above the layer 47 from being shorted out by the silicon below. In operation, the layer 47 functions as a standoff so that heat moves away from, rather than toward, the silicon die 49.

A layer 45, formed by plasma enhanced chemical vapor deposition (PECVD) of one embodiment, is deposited upon the layer 47. For another embodiment, layer 45 is formed by ALD and is about 250 angstroms thick. For one embodiment, layer 45 is a layer of an amorphous material, such as silicon nitride ($Si_3N_4$). The layer 45 chemically stabilizes the underlying TEOS-oxide layer 47 and provides thermal and chemical stabilization of resistive layer 48. Resistive layer 48 is patterned on layer 45 and is chemically defined by an etching process. Layer 48 is comprised of resistive materials such as tantalum, aluminum, silicon, or tantalum nitride and it functions to resistively heat the overlying structure to enable ejection of an ink droplet.

The overlying structure includes a passivation layer 42 that is deposited, patterned, and etched to open up contact holes at end of the resistive layer 48. Specifically, passivation layer 42 is deposited on layer 45 and layer 48 using ALD. Passivation layer 42 is structured to create interconnects to a layer 41 (e.g., about 0.5 micron thick). In one embodiment, the layer 41 is a thin tungsten film (e.g., about 0.5 micron thick) deposited and patterned by plasma processes. Overlying the tungsten layer 41 is a TEOS-oxide layer (e.g., about 0.6 micron thick) 39 that is disposed laterally in relation to the firing chamber 24. The layer 39 is etched to enable an overlying aluminum contact terminal 35 to contact the tungsten layer 41. In this manner, the layer 39 functions as an interdielectric between two metals, the underlying tungsten layer 41 and the overlying aluminum contact terminal 35.

In the embodiment shown in FIG. 1, the firing chamber 24 includes a cavitation layer 31 deposited over the stack 26 and in contact laterally with a tetra ethyl ortho silicate (TEOS)-oxide layer e.g., about 0.6 micron thick) 33. The cavitation layer 31 provides mechanical protection to the underlying structure and, in particular, prevents chemical and impact damage to the resistor 48. The TEOS layer 33, on the other hand, provides insulation for the layers of the fluid-ejection device and separates the cavitation layer 31 from other structures. It will be noted that the cavitation layer 31 is isolated throughout the ejection device 21, except where it contacts the ALD passivation layer 42. Cavitation layer 31 can be of tantalum (Ta), titanium (Ti), molybdenum (Mo), niobium (Nb), etc. For one embodiment, cavitation layer 31 is deposited on layer 33 and layer 42 using ALD. For another embodiment cavitation layer 31 is about 500 angstroms thick. Using ALD for cavitation layer 31 results in conformal coverage over layer 33 and produces a low-stress, substantially crack-free film.

For some embodiments, a passivation layer 10 is disposed on layer 33 using ALD, chemical vapor deposition, or the like. For one embodiment, passivation layer 110 is a carbide layer, such as SiC silicon carbide, diamond like carbons (DLCs), e.g., fullerenes or graphite, etc. Passivation layer 110 acts to protect layer 33 against inks and other fluids. Passivation layer 110 also acts to protect against wear.

In one embodiment, the passivation layer 42 is a dielectric film, such as silicon carbide, diamond like carbon, aluminum oxide etc. For one embodiment, passivation layer 42 has a thickness of between about 250 angstroms and 2000 angstroms. For another embodiment, passivation layer 42 has a thickness between about 250 to 500 angstroms, preferably about 300 angstroms. This thin film enables substantially reduced drive energies because of the thinness of the dielectric and, possibly, because of enhanced thermal conductivity. Dielectrics that can be deposited by the ALD technique contain refractory metals, transitional metals, and insulators, such as silicates. Other dielectrics depositable by atomic level deposition include metal oxides, nitrides, borides, and carbides.

Examples of oxides depositable by atomic level deposition include aluminum oxide ($Al_2O_3$), titanium oxide ($TiO_2$), tantalum oxide ($Ta_2O_5$), hafnium oxide ($HfO_2$), magnesium oxide (MgO), cesium oxide ($CeO_2$), niobium oxide ($Nb_2O_5$), lanthanum oxide ($La_2O$), yttrium oxide ($Y_2O_3$), aluminum titanium oxide ($Al_xTi_yO_z$), tantalum hafnium oxide ($Ta_xHf_yO_z$), etc. Examples of nitrides depositable by atomic level deposition include silicon nitride (SiN), aluminum nitride (AlN), titanium nitride (TiN), tantalum nitride (TaN), niobium nitride (NbN), molybdenum nitride (MoN), tungsten nitride (WN), etc. Examples of refractory metals depositable by atomic level deposition include tantalum (Ta), titanium (Ti), tungsten (W), molybdenum (Mo), niobium (Nb), titanium nitride (TiN), tantalum nitride (TaN), niobium nitride (NbN), molybdenum nitride (MoN), tungsten nitride (WN), etc. Examples of transitional metals depositable by atomic level deposition include tantalum (Ta), titanium (Ti), tungsten (W), copper (Cu), molybdenum (Mo), hafnium (Hf), etc. Examples of borides depositable by atomic level deposition include titanium diboride ($TiB_2$), zirconium diboride ($ZrB_2$), arsenic hexaboride ($AsB_6$), etc.

During the ALD process, a source-material precursor and a binding precursor are employed alternately with inert purge gasses in between. The purge gasses ensure that no stray gasses, such as the source-material precursor, are present before the next gas, such as the binding precursor, is employed. The deposited source-material precursor chemically reacts on the surface with the deposited binding precursor to form a single molecular ALD layer. The single molecular ALD layers build up molecular layer-by-molecular layer using this process. As a result of the monolayer-by-monolayer build up, the final thickness of the ALD layer is well controlled Examples of source-material precursors include trimethylated aluminum ($Al(CH_3)_3$), aluminum trichloride ($AlCl_3$), titanium tetrachloride ($TiCl_4$), tantalum pentachloride ($TaCl_5$), bis(tert-butylimido), bis(dimethylamido) tungsten ($(BuN)_2(Me_2N)_2W$), methane ($CH_4$), etc. Examples of binding precursors include oxygen-source materials, e.g., water vapor, a nitrogen-source materials, e.g., ammonia, hydrogen, etc.

For one embodiment, the source-material precursors include a dopant, such as aluminum, nitrogen, carbon, oxygen, etc. For this embodiment, the ALD process is used to deposit layers that include the dopant. For another embodiment, the ALD process is used to deposit a cavitation layer 31 with a dopant. For some embodiments, the dopant, e.g., nitrogen or the like, reduces a thermal resistance of cavitation layer 31. This acts to reduce the thermal resistance between resistive layer 48 and ink contained in firing chamber 24, resulting in a lower turn-on energy.

For another embodiment, the ALD process is used to deposit a passivation layer 42 that includes a dopant, such as aluminum, boron, phosphorous, germanium, barium, calcium, strontium, etc., for reducing the thermal resistance of layer 42, which acts to reduce the thermal resistance between resistive layer 48 and ink contained in firing chamber 24. For other embodiments, adding a dopant to layer 42, e.g., carbon, oxygen, etc., acts to increase the thermal resistance of layer 42. For other embodiments, dopants such as phosphorous, oxygen, carbon, nitrogen, etc., act to increase the hardness, reduce plastic flow, etc. of the respective layer.

For some embodiments, a seed layer 115, e.g., of tungsten, titanium nitride, or tantalum nitride is deposited on ALD passivation layer 42 using ALD and layer 41 is subsequently formed on seed layer 115. For other embodiments, a seed layer 120, e.g., of titanium nitride or tantalum, is deposited on layer 39 using ALD and aluminum contact terminal 35 is subsequently formed on seed layer 120. For various embodiments, seed layers 115 and 120 are about 100 angstroms thick.

Figure 2:
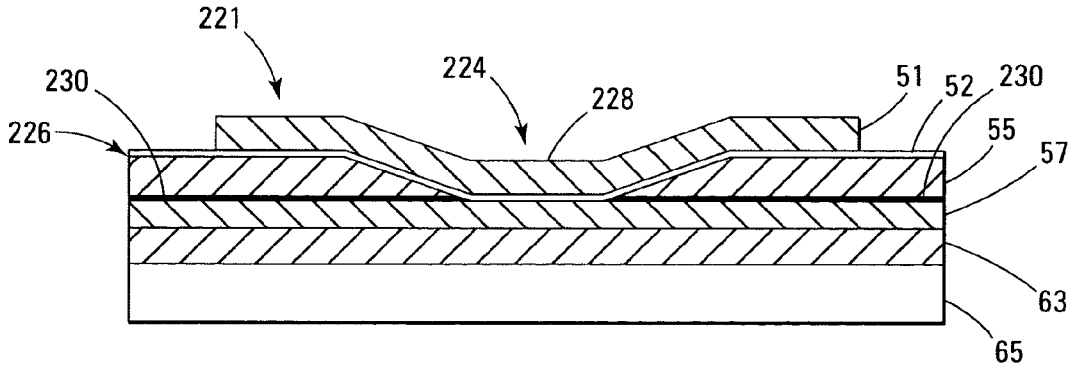
FIG. 2 is a cross-sectional view of a portion of a fluid-ejection device according to another embodiment of the present invention.

FIG. 2 is an unscaled cross-sectional view of a fluid-ejection device 221 according to another embodiment of the present invention. The device 221 is comprised of a plurality (or stack) of thin-film layers, generally indicated by the reference numeral 226. The device 221 utilizes ALD layers, and utilizes contact termination as described above in reference to the ejection device 21. The fluid-ejection device 221 includes a firing chamber 224. In addition, the fluid-ejection device 221, like the device 21 of FIG. 1, is comprised of a plurality of thin-film layers stacked on a silicon die 65.

The die 65 is similar in structure and function to the die 49 of FIG. 1. A field oxide or TEOS layer (e.g., about 1.0 micron thick) 63, similar in structure and function to the layer 47 of FIG. 1, is disposed on the die 65 and a heating (or resistor) layer 57, composed of tantalum/aluminum, or other suitable metal, is disposed on the layer 63. An aluminum layer (e.g., about 0.5 micron thick) 55 is disposed laterally of a region 228 of firing chamber 224 and overlying the layer 57. The aluminum layer 55 is covered by an ALD dielectric e.g., about 0.1 micron thick) film 52. The ALD film 52 is similar to the layer 42 of FIG. 1 and is formed according to the above-described process. For other embodiments, layer 52 is similar to and is formed as described for layer 110 of FIG. 1.

Firing chamber 224 includes a cavitation layer 51 deposited over the stack 226. For one embodiment, cavitation layer 51 is deposited on layer 33 using ALD. Cavitation layer 51 can be of tantalum (Ta), titanium (Ti), molybdenum (Mo), niobium (Nb), etc. For another embodiment cavitation layer 31 is about 500 angstroms thick. For one embodiment, a seed layer 230, e.g., of refractory metal, is deposited on layer 57 using ALD, and layer 55 is subsequently formed on seed layer 230. For some embodiments, seed layer 230 is about 100 angstroms thick.

Figure 3:
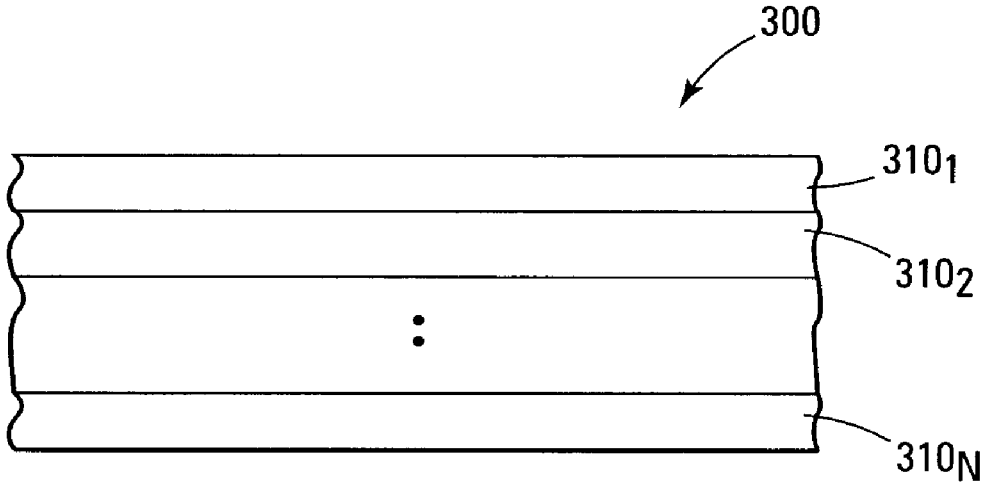
FIG. 3 illustrates a passivation layer according to another embodiment of the present invention.

For some embodiments, the passivation layers of the present invention, such as passivation layers 42 and 110 of FIG. 1 and passivation layer 52 of FIG. 2 include multiple layers as is shown generally for a passivation layer 300 in FIG. 3. For one embodiment, passivation layer 300 includes layers $\mathbf{310}_1$ to $\mathbf{310}_N$. For another embodiment, each of layers $\mathbf{310}_1$ to $\mathbf{310}_N$ is formed using ALD, chemical vapor deposition (CVD) or the like and has a thickness between about 250 angstroms and about 350 angstroms. For another embodiment, some of the layers 310 are formed using ALD and others are formed using CVD, for example. For one embodiment, some of the layers 310 are of one material, such as silicon carbide and others are of another material, such as silicon nitride. For another embodiment, passivation layer includes two layers, e.g., one of silicon nitride the other of silicon carbide.

The present invention affords several distinct advantages. Because the ALD passivation layers are so thin, they permit reduced drive energies with consequent low turn on energy drop generation of the resistor, for example, in the resistor regions of the ejection devices 21 and 221. This, in turn, results in faster thermal response, thereby enabling a higher frequency of operation. The present invention enables rapid print head resistor heating and cool down. As a result, a thermally more efficient print head is achieved with resulting swath size increases. Such increases, in turn, substantially improve fluid-ejection device throughput.

In another embodiment, the invention affords the flexibility of using very thin multiple dielectrics for custom tailoring of thermal properties. This is because the ALD process enables addition of a single molecular layer at a time, a dielectric film having a precise predetermined thickness can be achieved.

A possible limitation of ALD is low growth rate that may lead to potential problems in mass production. Thus, ALD may not be able to compete with other widely used thin film deposition techniques, such as chemical vapor deposition (CVD) or physical vapor deposition (PVD).

Advantageously, however, the films produced by the ALD technique have low stresses and are substantially free of voids, pinholes, and cracks. These attributes of ALD films act to increase resistor life and print head life.

Because the chemical purity is very high, resistor printing and storage life are substantially extended. The high thermal efficiency of the present invention translates into comparatively lower steady state die temperatures and enhanced resistor life.

It is known by those skilled in the art that electrical shorts reduce yield in some fluid-ejection devices. In the embodiments described above, high particle tolerance in passivation is achieved. Thus, the likelihood of shorts is diminished thereby raising circuit yield.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A method of forming a cavitation layer of a print head comprising:

forming a first dielectric layer overlying at least a first portion of a substrate using atomic layer deposition;

forming a second dielectric layer having a first portion overlying at least a second portion of the substrate and a second portion, different from the first portion, overlying at least a portion of the first dielectric layer;

forming a cavitation layer overlying the first dielectric layer and in lateral contact with the first portion of the second dielectric layer using atomic layer deposition; and forming a third dielectric layer only on the second portion of the second dielectric layer using atomic layer deposition.

2. The method of claim 1, wherein at least one of the first and second dielectric layers is a carbide layer.

3. The method of claim 1, wherein the first dielectric layer comprises a plurality of first dielectric layers, wherein at least one of the plurality of first dielectric layers is a silicon carbide layer and at least another of the plurality of first dielectric layers is a silicon nitride layer.

4. The method of claim 1 further comprises:

before forming the second dielectric layer, forming a seed layer overlying the second portion of the substrate using atomic layer deposition; and before forming the second dielectric layer, forming a conductive metal layer on the seed layer.

5. The method of claim 4, wherein the conductive metal layer is aluminum or tungsten.

6. The method of claim 5, wherein the conductive metal layer forms one or more contacts.

7. The method of claim 1 further comprising forming a resistive layer before forming the first dielectric layer, wherein forming the first dielectric layer comprises forming the first dielectric layer on the resistive layer.

* * * * *

UNITED STATES PATENT AND TRADEMARK OFFICE

CERTIFICATE OF CORRECTION

PATENT NO. : 7,025,894 B2
APPLICATION NO. : 10/620666
DATED : April 11, 2006
INVENTOR(S) : Ulrich E. Hess et al.

It is certified that error appears in the above-identified patent and that said Letters Patent is hereby corrected as shown below:

In column 3, line 57, delete “10” and insert -- 110 --, therefor.

Signed and Sealed this

Twenty-first Day of April, 2009

John Doll

JOHN DOLL
*Acting Director of the United States Patent and Trademark Office*